US005453820A

United States Patent [19]

Ueno et al.

[11] Patent Number: 5,453,820

[45] Date of Patent: Sep. 26, 1995

[54] DEVELOPING DEVICE HAVING A DEVELOPER MIXING CHAMBER FOR USE IN ELECTROPHOTOGRAPHIC APPARATUS

[75] Inventors: Hiroshi Ueno; Yasuyuki Tsuji; Shuuho Yokokawa; Isao Nakajima; Tsukasa Onose; Yoshio Ogura; Katsuhiro Shinohara, all of Ibaraki, Japan

[73] Assignee: Hitachi Koki Co., Ltd., Tokyo, Japan

[21] Appl. No.: 154,448

[22] Filed: Nov. 19, 1993

[30] Foreign Application Priority Data

Nov. 20, 1992 [JP] Japan ..... 4-312308

[51] Int. Cl.[6] ..... G03G 15/08

[52] U.S. Cl. ..... 355/253; 118/657

[58] Field of Search ..... 355/251, 253; 118/657, 658

[56] References Cited

U.S. PATENT DOCUMENTS 3,654,902 4/1972 Hakanson ..... 118/658

4,050,413 9/1977 Parker ..... 118/658 X 4,068,623 1/1978 O'Toole et al. ..... 118/658

4,690,096 9/1987 Hacknauer et al. ..... 118/657

*Primary Examiner*—Joan H. Pendegrass

*Attorney, Agent, or Firm*—Sughrue, Mion, Zinn, Macpeak & Seas

[57] ABSTRACT

A developing device for use in an electrophotographic apparatus includes a casing for storing a developer including a toner and a carrier therein; a photosensitive drum having a surface on which an electrostatic latent image is formed; a carrying magnetic roll for drawing up the developer stored in said casing; a developing magnetic roll for forming a magnetic brush out of the developer fed by the carrying magnetic roll to develop the electrostatic latent image; and a developer mixing chamber including an impeller interposed between the carrying and developing magnetic rolls, for mixing the toner and carrier contained in the developer with each other, which is drawn up by the carrying magnetic roll, to supply the mixed developer to the developing magnetic roll.

15 Claims, 2 Drawing Sheets

DEVELOPING DEVICE HAVING A DEVELOPER MIXING CHAMBER FOR USE IN ELECTROPHOTOGRAPHIC APPARATUS

BACKGROUND OF THE INVENTION

1 . Field of the Invention

The present invention relates to a developing device for use in an electrophotographic apparatus.

2. Description of the Related Art

The structure of a conventional developing device will be described with reference to FIG. 1.

In FIGS. 1(*a*) to 1(*c*), reference numeral 1 designates a casing for accommodating a developing device. In the bottom portion of the casing 1, there is disposed a carrying magnetic roll 2 in such a manner that it can be rotated in a direction of an arrow a and, at the upper right portion of the carrying magnetic roll 2, there is disposed a developing magnetic roll 3 in such a manner that it can be rotated in a direction of an arrow b. Also, in the casing 1, there is stored a developer 4 in such a manner that the carrying magnetic roll 2 can be submerged in the developer.

In FIGS. 1(*a*) to 1(*c*), reference numeral 5 designates a doctor plate, 6 a photosensitive drum which forms an electrostatic image holder, 7 a developer peel-off plate, and 8 a developer supply device.

Now, description will be given below of the operation of the developing device having the above-mentioned structure when it performs a developing step.

If the carrying magnetic roll 2 and developing magnetic roll 3 start their rotational operations from a state shown in FIG. 1(*a*), then, as shown in FIG. 1(*b*), the developer 4 is drawn up by the carrying magnetic roll 2 and the developer 4, which has been attached to the carrying magnetic roll 2, is extended over to the side of the developing magnetic roll 3 due to a magnetic action between the two magnetic rolls 2 and 3.

The developer 4 absorbed to the developing magnetic roll 3 can be restricted to a given developer layer thickness by passing the developer 4 through the doctor plate 5. The developer, which has been scraped off by the doctor 5, is returned to the developer storage side, whereas the developer, which has been held by the developing magnetic roll 3 and has been carried to the photosensitive drum 6, is used to develop electrostatic latent images formed on the surface of the photosensitive drum 6 in a developing area D or the like. After passing through the developing area D, the developer held by the developing magnetic roll 3 is scraped away by the developer peel-off plate 7 disposed close to the developing magnetic roll 3. In the following description, in order to distinguish the developer before passing through the developing area D from the developer after passing through the developing area D, reference number 4 is given to the developer before passing through the developing area D and 40 is given to the developer after passing through the developing area D.

The developer 40 scraped off by the developer peel-off plate 7 is slid down on the upper surface of the developer peel-off plate 7 and then returned to the developer storage side.

When, in the conventional developing device having the above-mentioned structure, there is used a developer which is prepared by mixing a toner and a carrier at a given ratio, there are produced a portion (developer 40) in which the ratio of the toner to the carrier is reduced because the toner is consumed in the developing area D, and a portion (developer 4) in which the ratio of the toner to the carrier is not reduced because the developer is not carried into the developing area D and thus the toner is not consumed. Therefore, the amount of toner corresponding to the amount of consumption must be supplied to the developer consisting of the above-mentioned developer 40 every given period by the developer supply device 8.

However, in the conventional developing device, even although it includes the above-mentioned developer supply device 8, as the toner 9 is simply allowed to fall down to the developer storage side, the toner 9 and developer 40 cannot be mixed together well, with the result that, as shown in FIG. 1(*c*), there are produced in the casing 1 three layers, that is, a toner layer 9*a* formed of the toner 9, a layer formed of the developer 4, and a layer formed of the developer 40. Therefore, if the toner layer 9*a* is carried into the developing area D, a stained background phenomenon (a phenomenon that a toner stain occurs in the background of a printed matter) can be invited, or, if the layer formed of the developer 40 is carried into the developing area D, then a printed matter of a low density can be produced due to a shortage of the toner.

SUMMARY OF THE INVENTION

The present invention aims at eliminating the drawbacks found in the conventional developing device. Accordingly, it is an object of the invention to provide a developing device which is able to sufficiently mix together a developer, which has been used once in the developing area, and a developer different from this.

In attaining the above object, according to the invention, there is provided a developing device for an electrophotographic apparatus in which there is interposed a developer mixing chamber having a developer mixing impeller between a carrying magnetic roll and a developing magnetic roll, and after a developer drawn up by the carrying magnetic roll is mixed in the developer mixing chamber, the developer is supplied to the developing magnetic roll.

According to the developing device for an electrophotographic apparatus constituted in the abovementioned manner, a developer used once in a developing area can be mixed sufficiently with a developer not used in the developer mixing chamber, which eliminates the possibility of inviting a background stain phenomenon, low density printing and the like to thereby stabilize the quality of a printed matter.

Also, when a developer prepared by mixing a toner with a carrier is used as a developer, the carrier contained in the developer stored in a casing and a newly supplied toner can be frictionally charged sufficiently in the developer mixing chamber.

BRIEF DESCRIPTION OF THE INVENTION

Other objects, advantages and features of the invention will be apparent when carefully reading the following detailed description in connection with the accompanying drawings, in which:

FIGS. 1(*a*) to 1(*c*) are sectional views showing a conventional developing device, respectively; and FIG. 2 is a section view showing a developing device according to an embodiment of the invention.

DETAILED DESCRIPTION OF THE PREFERRED EMBODIMENT

Description will be given below of a developing device according to an embodiment of the invention with reference to FIG. 2.

Figure 1A:
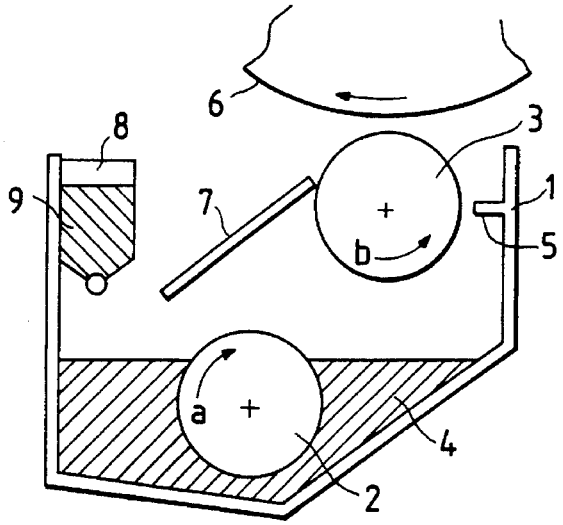
FIG. 1(a) PRIOR ART
Figure 1B:
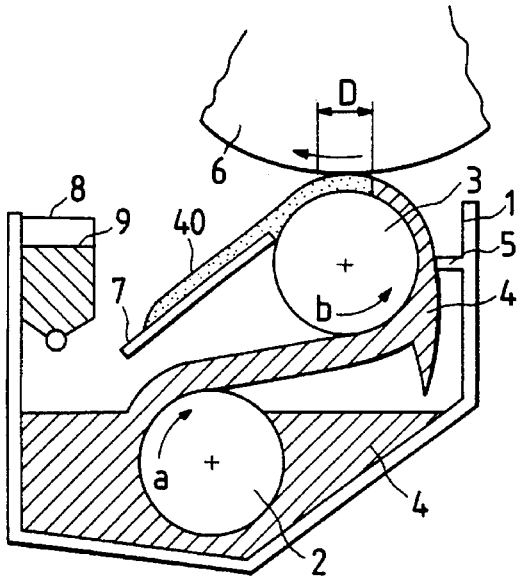
FIG. 1(b) PRIOR ART
Figure 1C:
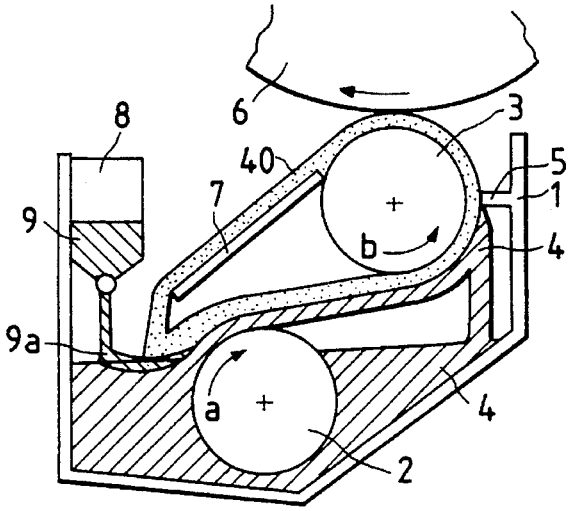
FIG. 1(c) PRIOR ART
Figure 2:
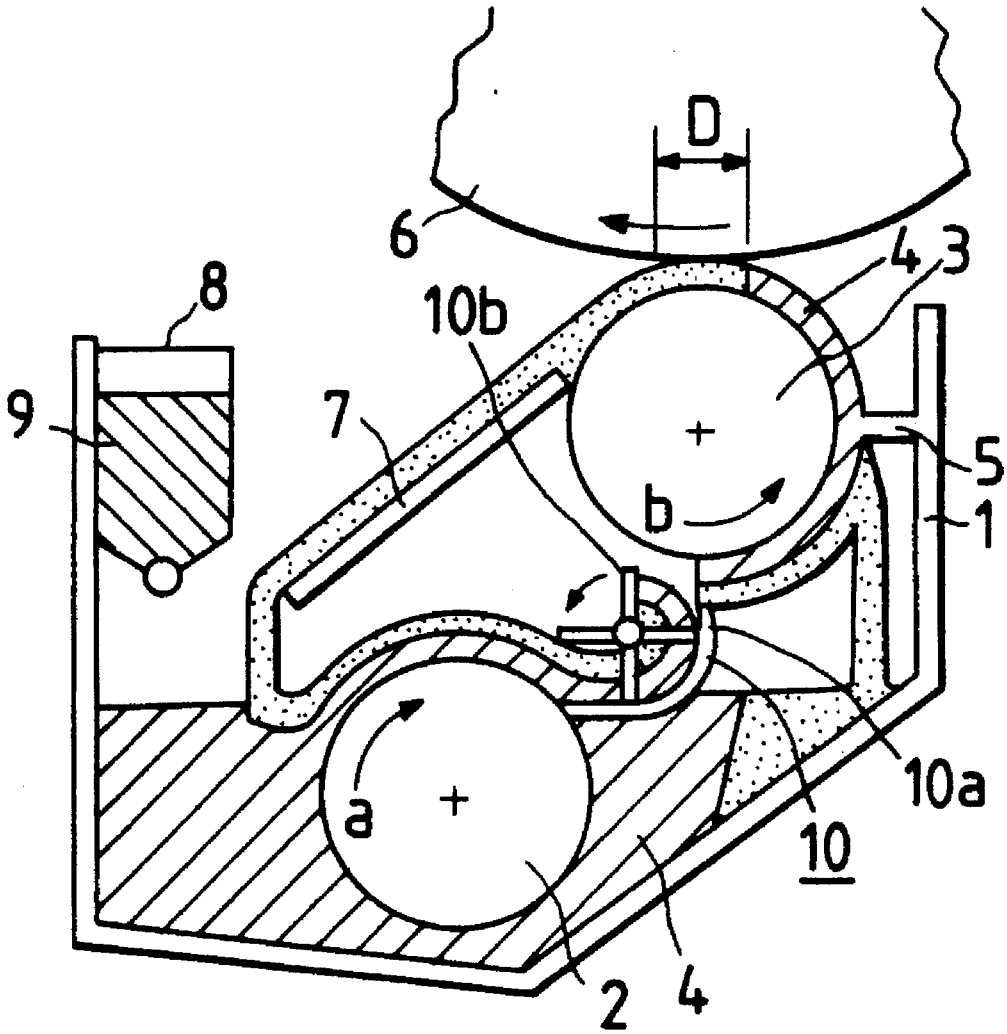

In FIG. 2, parts having the same structure as those shown in FIGS. 1(*a*) to 1(*c*) are given the same designations, and therefore the description thereof is omitted here.

In FIG. 2, reference character 10*a* designates a plate member which forms a developer mixing chamber 10 and is interposed between a carrying magnetic roll 2 and a developing magnetic roll 3. The plate member 10*a* has a substantially L-shaped section. One end of the plate member 10*a* is brought in close contact with the outer peripheral surface of the carrying magnetic roll 2 and the other end thereof is disposed at a given distance from the outer peripheral surface of the developing magnetic roll 3, whereby only the developer drawn up from the carrying magnetic roll 2 can be stored there temporarily. Also, in the neighborhood of the plate member 10*a*, there is disposed a developer mixing impeller 10*b* for stirring the developer therewith, which can be rotated in the opposite direction (counterclockwise in FIG. 2) to the carrying magnetic roll 2.

According to the developing device thus organized, even when the respective developer layers are drawn up by the carrying magnetic roll 2 in such a manner that they are not mixed together, the respective developer layers can be mixed together sufficiently in the developer mixing chamber 10, and after the respective developer layers are mixed together in the developer mixing chamber 10, the developer can be supplied to the developing magnetic roll 3.

As has been described heretofore, according to the invention, in a developing device which comprises a carrying magnetic roll and a developing magnetic roll disposed in parallel to each other in a casing of the developing device, wherein a developer stored in the casing is drawn up by means of the carrying magnetic roll and then fed to the developing magnetic roll, a magnetic brush is formed out of the developer adsorbed to the developing magnetic roll, and an electrostatic latent image formed in an electrostatic image holder is developed by use of the magnetic brush, there is disposed between the carrying and developing magnetic rolls a developer mixing chamber including a developer mixing impeller, and after the developer drawn up by the carrying magnetic roll is mixed in the developer mixing chamber, the developer is supplied to the developing magnetic roll, whereby a developer used once in a developing area and a developer not used can be mixed together sufficiently in the developer mixing chamber, and therefore the printing quality can be stabilized without inviting a background stain phenomenon or low density printing.

Also, when there is used a developer prepared by mixing a toner and a carrier, the carrier in the developer stored in the casing and a newly supplied toner can be frictionally charged sufficiently in the developer mixing chamber.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developing device for use an electrophotographic apparatus, comprising:

a casing for storing a developer therein;

a photosensitive drum having a surface on which an electrostatic latent image is formed;

a carrying magnetic roll for drawing up said developer stored in said casing;

a developing magnetic roll for forming a magnetic brush out of said developer fed by said carrying magnetic roll to develop said electrostatic latent image formed on said photosensitive drum; and developer mixing means, interposed between said carrying and developing magnetic rolls, for mixing said developer drawn up by said carrying magnetic roll to supply said mixed developer to said developing magnetic roll, wherein said developer mixing means comprises a plate member for temporarily storing said developer supplied from said carrying magnetic roll, and an impeller for stirring said developer received by said plate member.

2. A developing device as claimed in claim 1, wherein said plate member is of a substantially L-shaped section.

3. A developing device as claimed in claim 1, wherein said plate member has one end which is brought in close contact with said carrying magnetic roll, and the other end thereof which is disposed at a given distance from said developing magnetic roll.

4. A developing device as claimed in claim 1, wherein said impeller rotates in a direction opposite to that of said carrying magnetic roll.

5. A developing device as claimed in claim 1, wherein said carrying and developing magnetic rolls are arranged in parallel to each other.

6. A developing device as claimed in claim 1, wherein said developer comprises a toner and a carrier.

7. A developing device as claimed in claim 6, further comprising means for supplying said toner into said casing.

8. A developing device as claimed in claim 1, further comprising a doctor plate for restricting a layer thickness of said developer formed on said developing magnetic roll.

9. A developing device as claimed in claim 1, further comprising a developer peel-off plate for scrapping away a residual developer on said developing magnetic roll.

10. A developing device as claimed in claim 1, wherein said carrying magnetic roll rotates in a direction opposite to that of said developing magnetic roll.

11. A developing device for use in an electrophotographic apparatus, comprising:

a casing for storing a developer therein;

a photosensitive drum having a surface on which an electrostatic latent image is formed;

a carrying magnetic roll for drawing up said developer stored in said casing;

a developing magnetic roll for forming a magnetic brush out of said developer fed by said carrying magnetic roll to develop said electrostatic latent image formed on said photosensitive drum;

a developer mixing chamber, interposed between said carrying and developing magnetic rolls, for temporarily storing said developer supplied from said carrying magnetic roll; and an impeller for stirring said developer received by said developer mixing chamber, thereby to mix said developer drawn up by said carrying magnetic roll to supply said mixed developer to said developing magnetic roll.

12. A developing device as claimed in claim 11, wherein said developer mixing chamber comprises a plate member.

13. A developing device as claimed in claim 11, wherein said plate member is of a substantially L-shaped section.

14. A developing device as claimed in claim 12, wherein said plate member has one end which is brought in close contact with said carrying magnetic roll, and the other end thereof which is disposed at a given distance from said developing magnetic roll.

15. A developing device as claimed in claim 12, wherein said impeller rotates in a direction opposite to that of said carrying magnetic roll.

* * * * *